US006606797B1

(12) United States Patent
Gandy

(10) Patent No.: US 6,606,797 B1
(45) Date of Patent: Aug. 19, 2003

(54) LASER SIGHTING DEVICE

(76) Inventor: Roger A. Gandy, 18 Burgess, Hobbs, NM (US) 88240

( * ) Notice: Subject to any disclaimer, the term of this patent is extended or adjusted under 35 U.S.C. 154(b) by 0 days.

(21) Appl. No.: 09/466,095

(22) Filed: Dec. 17, 1999

(51) Int. Cl.[7] ..... F41G 1/34
(52) U.S. Cl. ..... 33/227; 33/DIG. 21; 42/116
(58) Field of Search ..... 33/227, DIG. 21; 42/114, 116, 120, 121, 123, 132

(56) References Cited

U.S. PATENT DOCUMENTS

| | | | | |
|---|---|---|---|---|
| 3,782,832 A | | 1/1974 | Hacskaylo | |
| 4,164,081 A | | 8/1979 | Berke | |
| 4,530,162 A | | 7/1985 | Forrest et al. | |
| 4,825,258 A | | 4/1989 | Whitson | |
| 5,365,669 A | * | 11/1994 | Rustick et al. | 33/DIG. 21 |
| 5,488,795 A | * | 2/1996 | Sweat | 42/116 |
| 5,531,040 A | | 7/1996 | Moore | |
| 5,685,106 A | * | 11/1997 | Shoham | 42/116 |
| D389,221 S | | 1/1998 | Borg | |
| 5,741,185 A | | 4/1998 | Kwan et al. | |
| 5,787,631 A | | 8/1998 | Kendall | |
| 6,096,049 A | * | 8/2000 | McNeirney et al. | 33/DIG. 21 |
| 6,151,788 A | * | 11/2000 | Cox et al. | 33/DIG. 21 |

* cited by examiner

*Primary Examiner*—G. Bradley Bennett

(57) ABSTRACT

A laser sighting device for improving the overall targeting accuracy of the gun. The laser sighting device includes a casing having an open front end, an open back end, a side wall, a first flange member being securely disposed upon and extending from the interior of the side wall intermediate of the ends, a second flange member being securely disposed upon and extending from the interior of the side wall at the back end thereof, and also includes a laser light which includes a body member having a laser diode at a front end and a contact pole at the back end thereof with the body member being engaged in the casing at the open front end, and also includes a contact switch member having housing, a front wall, a side wall, and open back end which is closeable with a cap member, a flange member securely disposed about the exterior of the side wall, and a flanged portion near the back end of the housing, and further includes a spring mounted about the contact switch member and three batteries removeably disposed within the housing for energizing the laser light.

8 Claims, 2 Drawing Sheets

LASER SIGHTING DEVICE

BACKGROUND OF THE INVENTION

1. Field of the Invention

The present invention relates to laser sighter and more particularly pertains to a new laser sighting device for improving the overall targeting accuracy of the gun.

2. Description of the Prior Art

The use of laser sighter is known in the prior art. More specifically, laser sighter heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,787,631 U.S. Pat. No. 4,164,081; U.S. Pat. No. 5,741,185; U.S. Pat. No. 3,782,832; U.S. Pat. No. 4,530,162; and U.S. Pat. No. 4,825,258.

While these devices fulfill their respective, particular objectives and requirements, the aforementioned patents do not disclose a new laser sighting device. The inventive device includes a casing having an open front end, an open back end, a side wall, a first flange member being securely disposed upon and extending from the interior of the side wall intermediate of the ends, a second flange member being securely disposed upon and extending from the interior of the side wall at the back end thereof, and also includes a laser light which includes a body member having a laser diode at a front end and a contact pole at the back end thereof with the body member being engaged in the casing at the open front end, and also includes a contact switch member having housing, a front wall, a side wall, and open back end which is closeable with a cap member, a flange member securely disposed about the exterior of the side wall, and a flanged portion near the back end of the housing, and further includes a spring mounted about the contact switch member and three batteries removeably disposed within the housing for energizing the laser light.

In these respects, the laser sighting device according to the present invention substantially departs from the conventional concepts and designs of the prior art, and in so doing provides an apparatus primarily developed for the purpose of improving the overall targeting accuracy of the gun.

SUMMARY OF THE INVENTION

In view of the foregoing disadvantages inherent in the known types of laser sighter now present in the prior art, the present invention provides a new laser sighting device construction wherein the same can be utilized for improving the overall targeting accuracy of the gun.

The general purpose of the present invention, which will be described subsequently in greater detail, is to provide a new laser sighting device apparatus and method which has many of the advantages of the laser sighter mentioned heretofore and many novel features that result in a new laser sighting device which is not anticipated, rendered obvious, suggested, or even implied by any of the prior art laser sighter, either alone or in any combination thereof.

To attain this, the present invention generally comprises a casing having an open front end, an open back end, a side wall, a first flange member being securely disposed upon and extending from the interior of the side wall intermediate of the ends, a second flange member being securely disposed upon and extending from the interior of the side wall at the back end thereof, and also includes a laser light which includes a body member having a laser diode at a front end and a contact pole at the back end thereof with the body member being engaged in the casing at the open front end, and also includes a contact switch member having housing, a front wall, a side wall, and open back end which is closeable with a cap member, a flange member securely disposed about the exterior of the side wall, and a flanged portion near the back end of the housing, and further includes a spring mounted about the contact switch member and three batteries removeably disposed within the housing for energizing the laser light.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new laser sighting device apparatus and method which has many of the advantages of the laser sighter mentioned heretofore and many novel features that result in a new laser sighting device which is not anticipated, rendered obvious, suggested, or even implied by any of the prior art laser sighter, either alone or in any combination thereof.

It is another object of the present invention to provide a new laser sighting device which may be easily and efficiently manufactured and marketed.

It is a further object of the present invention to provide a new laser sighting device which is of a durable and reliable construction.

An even further object of the present invention is to provide a new laser sighting device which is susceptible of a low cost of manufacture with regard to both materials and labor, and which accordingly is then susceptible of low prices of sale to the consuming public, thereby making such laser sighting device economically available to the buying public.

Still yet another object of the present invention is to provide a new laser sighting device which provides in the apparatuses and methods of the prior art some of the advantages thereof, while simultaneously overcoming some of the disadvantages normally associated therewith.

Still another object of the present invention is to provide a new laser sighting device for improving the overall targeting accuracy of the gun.

Yet another object of the present invention is to provide a new laser sighting device which includes a casing having an open front end, an open back end, a side wall, a first flange member being securely disposed upon and extending from the interior of the side wall intermediate of the ends, a second flange member being securely disposed upon and extending from the interior of the side wall at the back end thereof, and also includes a laser light which includes a body member having a laser diode at a front end and a contact pole at the back end thereof with the body member being engaged in the casing at the open front end, and also includes a contact switch member having housing, a front wall, a side wall, and open back end which is closeable with a cap member, a flange member securely disposed about the exterior of the side wall, and a flanged portion near the back end of the housing, and further includes a spring mounted about the contact switch member and three batteries removeably disposed within the housing for energizing the laser light.

Still yet another object of the present invention is to provide a new laser sighting device that allows the user to quickly zero in on the target.

Even still another object of the present invention is to provide a new laser sighting device that substantially improves the handling and shooting of the gun by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
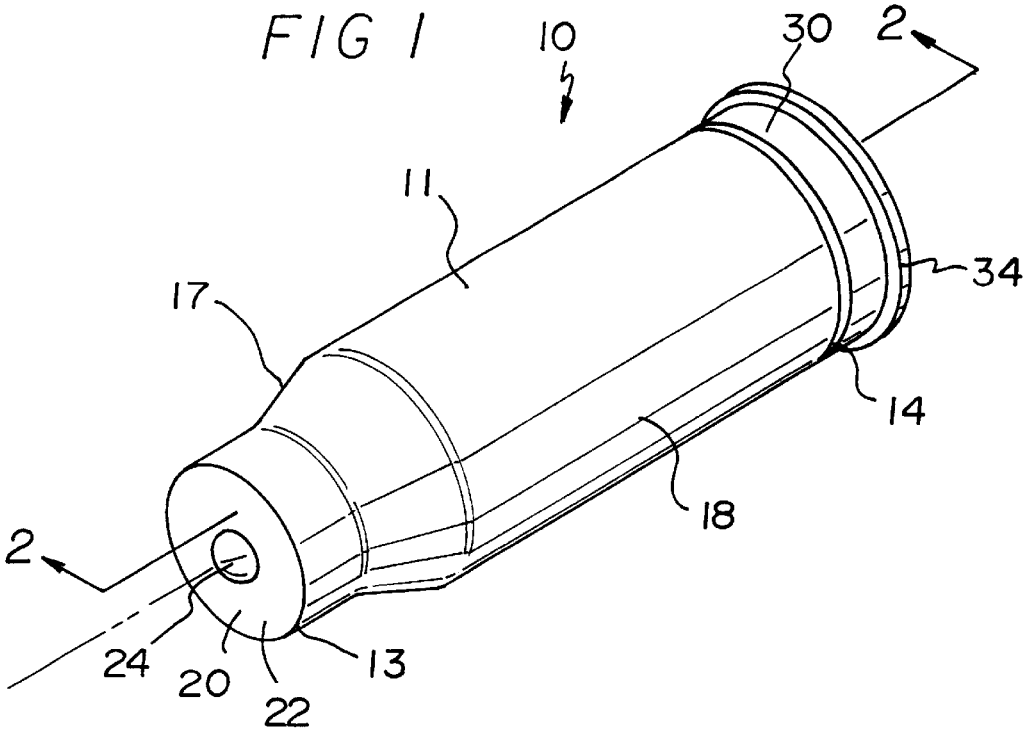
FIG. 1 is a perspective view of a new laser sighting device according to the present invention.
Figure 2:
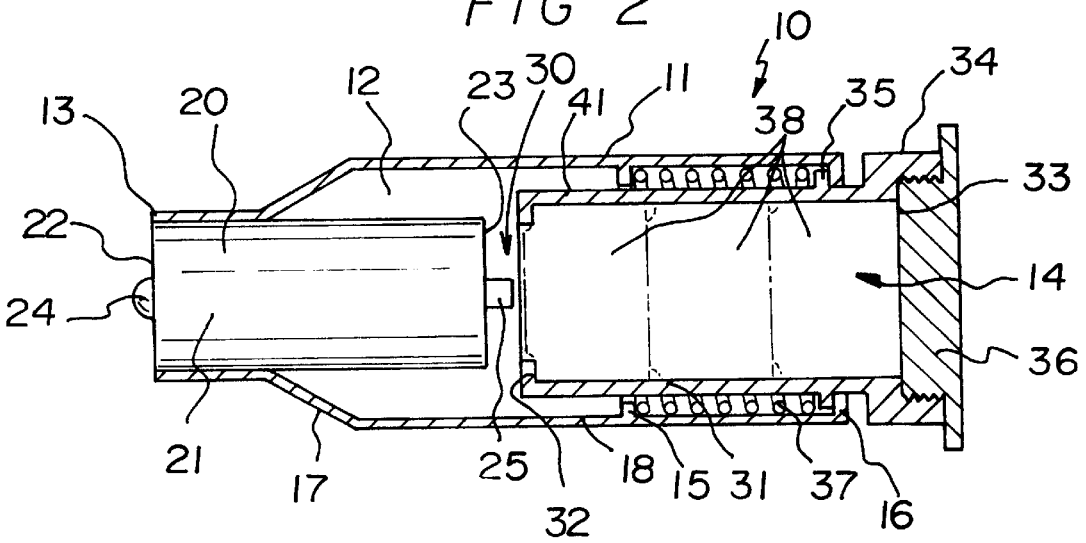
FIG. 2 is a side cross-sectional view of the present invention.
Figure 3:
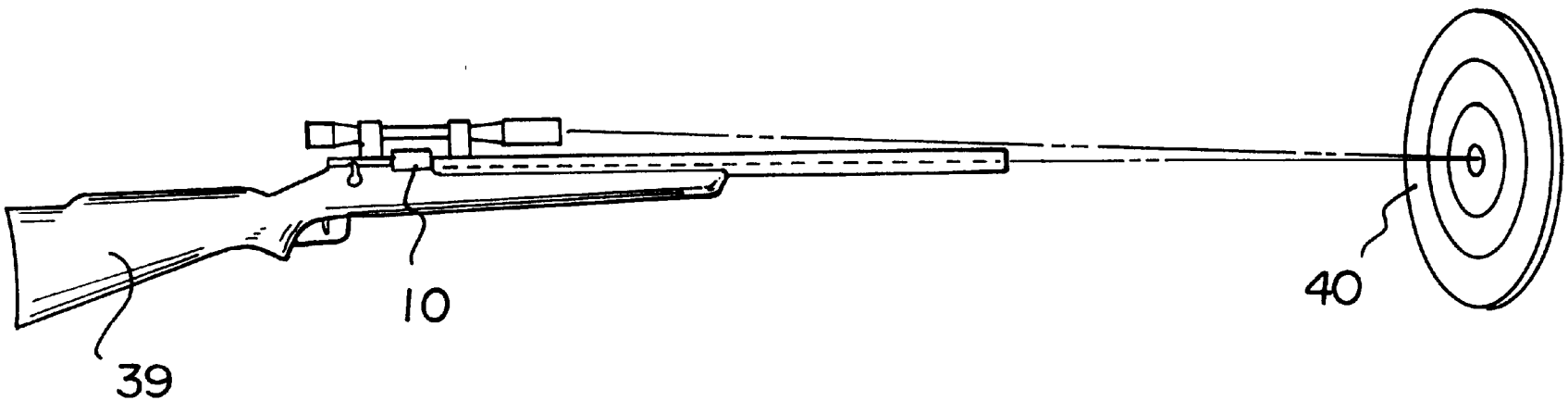
FIG. 3 is a side elevational view of the present invention mounted to a gun being used to sight a target.

With reference now to the drawings, and in particular to FIGS. 1 through 3 thereof, a new laser sighting device embodying the principles and concepts of the present invention and generally designated by the reference numeral 10 will be described.

As best illustrated in FIGS. 1 through 3, the laser sighting device 10 generally comprises a casing 11 having an open front 13 end, an open back end 14, a side wall 18, and a bore 12 extending therethrough. The casing 11 further includes a first 15 and second 16 flange members securely and integrally attached to and extending from an interior of the side wall 18 of the casing 11. The first flange member 15 is disposed intermediate of the front 13 and back 14 ends of the casing 11, and the second flange member 16 is spaced from the first flange member 15 and is disposed at the back end 14 of the casing 11. The casing 11 has a tapered portion 17 near the front end 13 with the tapered portion 17 being tapered forwardly of the casing 11. The laser sighting device 10 further includes a laser light means 20 which includes a body member 21 securely engaged in the casing 11 and having a front end 22 which is exposed at the front end 13 of the casing 11. The body member 21 further has a contact pole 25 extending outwardly from a back end 23 thereof, and includes a laser diode 24 disposed at the front end 22 thereof and being adapted to shine a beam of light forwardly of the casing 11. A means for energizing the laser light means includes a contact switch member 30 slidably extended in the casing 11 through the back end 14 thereof, a spring 37 mounted about the contact switch member 30 and disposed inside the casing 11, and three batteries 38 being removeably disposed inside and through the open back end 33 of the contact switch member 30. The contact switch member 30 is essentially a housing 31 having a front wall 32, a side wall 41, and an open back end 33 which is closeable with a cap member 36. The housing 31 further includes a flanged portion 34 integrally disposed about an exterior of the at least one side wall 41 near the back end 33 thereof for limiting movement of the housing 31 into the casing 11. The housing 31 also includes a flange member 35 securely and integrally disposed about an exterior of the side wall 41 near the back end 33 thereof with the flange member 35 being spaced from the flanged portion 34. The second flange member 16 is moveably disposed between the flanged portion 34 and the flange member 35 of the housing 31 to essentially retain the contact switch member 30 within the casing 11. The spring 37 is engaged between the first flange member 15 and the flange member 35 of the housing 31. The switch member 30 is biased away from the contact pole 25.

In use, the user can mount the laser sighting device 10 upon a gun 39 and use it to sight the target 40. In order to do so, the user presses the back end 33 of the contact switch member 30 toward the back end 14 of the casing 11 until the switch member 30 comes into contact with the contact pole 25 thus energizing the laser light means 20 which emits a laser light beam from the front end 13 of the casing 11 and onto the desired target 40. To turn off the laser light means 20, the user simply lets go of the contact switch member 30 which is moved away from the contact pole 25 by the spring 37.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A laser sighting device comprising:

a casing having an open front end, an open back end, at least one side wall, and a bore extending therethrough, an outer surface of said casing comprising a plurality of housing portions, said plurality of housing portions comprising:

a forward housing portion;

an intermediate housing portion, a front section of said intermediate housing portion extending into said forward housing portion, said intermediate housing portion being longitudinally movable with respect to said forward housing portion; and a rearward housing portion, a front section of said rearward housing portion extending into said intermediate housing portion, said front section of said rearward housing portion being threadedly mounted on a rear of said intermediate housing portion such that rotation of said rearward housing portion with respect to said intermediate housing portion adjusts the longitudinal protrusion of said rearward housing from said intermediate housing portion;

a biasing means for biasing said intermediate housing portion away from said forward housing portion;

a laser light means including a body member positioned in the forward housing portion of said casing and having a front end which is exposed at said front end the forward housing portion of said casing, said body member further having a contact pole extending outwardly from a back end thereof; and an energizing means for energizing said laser light means, said energizing means being removable from said intermediate housing portion by removal of said rearward housing portion from said intermediate housing portion.

2. A laser sighting device as described in claim 1, wherein said body member includes a laser diode disposed at said front end thereof and being adapted to shine a beam of light forwardly of said casing.

3. A laser sighting device as described in claim 2, wherein said means for energizing said laser light means includes at least one battery removably mounted in said intermediate housing portion with a contact of said battery being exposed through a front of said intermediate housing portion for selectively contacting said contact pole of said laser light means when the front section of said intermediate housing portion is moved in a forward longitudinal direction in said forward housing portion, said biasing means comprising a spring mounted about the front section of said intermediate housing portion and disposed inside the forward housing portion of said casing.

4. A laser sighting device as described in claim 1, wherein said intermediate housing portion further includes a flanged portion disposed about an exterior of the front section of said intermediate housing portion adjacent to back end of the front section for limiting movement of said housing into said casing.

5. A laser sighting device as described in claim 4, wherein said forward housing portion further includes a first and second flange members mounted to and extending from an interior of said forward housing portion for limiting movement of said flanged portion of said intermediate housing portion between said first and second flange members.

6. A laser sighting device as described in claim 5, wherein said biasing means comprises a spring positioned between said first flange member of said forward housing portion and said flange member of said intermediate housing portion.

7. A laser sighting device as described in claim 1, wherein said forward housing portion has a tapered front section.

8. A laser sighting device comprising:

a casing having an open front end, an open back end, at least one side wall, and a bore extending therethrough, an outer surface of said casing comprising a plurality of housing portions, said plurality of housing portions comprising:

a forward housing portion;

an intermediate housing portion, a front section of said intermediate housing portion extending into said forward housing portion, said intermediate housing portion being longitudinally movable with respect to said forward housing portion; and a rearward housing portion, a front section of said rearward housing portion extending into said intermediate housing portion, said front section of said rearward housing portion being threadedly mounted on a rear of said intermediate housing portion such that rotation of said rearward housing portion with respect to said intermediate housing portion adjusts the longitudinal protrusion of said rearward housing from said intermediate housing portion;

a biasing means for biasing said intermediate housing portion away from said forward housing portion;

a laser light means including a body member positioned in the forward housing portion of said casing and having a front end which is exposed at said front end the forward housing portion of said casing, said body member further having a contact pole extending outwardly from a back end thereof; and an energizing means for energizing said laser light means, said energizing means being removable from said intermediate housing portion by removal of said rearward housing portion from said intermediate housing portion;

wherein said body member includes a laser diode disposed at said front end thereof and being adapted to shine a beam of light forwardly of said casing;

wherein said means for energizing said laser light means includes at least one battery removably mounted in said intermediate housing portion with a contact of said battery being exposed through a front of said intermediate housing portion for selectively contacting said contact pole of said laser light means when the front section of said intermediate housing portion is moved in a forward longitudinal direction in said forward housing portion said biasing means comprising a spring mounted about the front section of said intermediate housing portion and disposed inside the forward housing portion of said casing;

wherein said intermediate housing portion further includes a flanged portion disposed about an exterior of the front section of said intermediate housing portion adjacent to back end of the front section for limiting movement of said housing into said casing; and wherein said forward housing portion further includes a first and second flange members mounted to and extending from an interior of said forward housing portion for limiting movement of said flanged portion of said intermediate housing portion between said first and second flange members.

* * * * *